United States Patent [19]

Tucker

[11] Patent Number: 5,002,501

[45] Date of Patent: Mar. 26, 1991

[54] ELECTRICAL PLUG

[75] Inventor: Donald L. Tucker, Redwood City, Calif.

[73] Assignee: Raychem Corporation, Menlo Park, Calif.

[21] Appl. No.: 415,757

[22] Filed: Oct. 2, 1989

[51] Int. Cl.[5] ..... H01R 4/24; H01R 19/08; H01R 13/68

[52] U.S. Cl. ..... 439/417; 439/622; 439/696

[58] Field of Search ..... 439/621, 622417, 695–697, 439/687; 337/197, 198

[56] References Cited

U.S. PATENT DOCUMENTS

| | | | |
|---|---|---|---|
| 1,953,966 | 4/1934 | Lynch | 439/687 |
| 3,858,144 | 12/1974 | Bedard et al. | 219/549 |
| 3,861,029 | 1/1975 | Smith-Johannsen et al. | 29/610.1 |
| 4,188,276 | 2/1980 | Lyons et al. | 219/528 |
| 4,388,607 | 6/1983 | Toy et al. | 219/549 |
| 4,426,339 | 1/1984 | Kamath et al. | 264/22 |
| 4,436,986 | 3/1984 | Carlson | 361/2 |
| 4,443,050 | 4/1984 | Taylor | 439/622 |
| 4,679,877 | 7/1987 | Ahroni | 439/622 |
| 4,701,138 | 10/1987 | Key | 439/417 |
| 4,822,983 | 4/1989 | Bremmer et al. | 219/505 |
| 4,826,449 | 5/1989 | Debortoli et al. | 439/417 |
| 4,834,664 | 5/1989 | Lin | 439/145 |

*Primary Examiner*—Gary F. Paumen

*Attorney, Agent, or Firm*—Marguerite E. Gerstner; Timothy H. P. Richardson; Herbert G. Burkard

[57] ABSTRACT

An electrical plug for connecting the first and second conductors of an electrical lead to an electrical power outlet. The plug is designed to contain a fuse. When the plug is connected to the power outlet and the fuse makes a proper electrical connection, a signal member provides a signal.

6 Claims, 2 Drawing Sheets

ELECTRICAL PLUG

BACKGROUND OF THE INVENTION

1. Cross-Reference to Related Applications

This application is related to copending, commonly assigned Application No. 07/415,820 (Tucker), filed contemporaneously with this application, the disclosure of which is incorporated herein by reference.

2. Field of the Invention

This invention relates to electrical plugs, particularly electrical plugs which are useful for making an electrical connection between an electrical lead and an electrical power outlet.

2. Introduction to the Invention

It is known to insert a light, or other signal, into an electrical circuit so that it is easy to determine whether current is flowing through a heater or other operational electrical device which forms part of the circuit. The light can, for example, be placed in a plug through which the device is connected to a wall outlet in a building or to another power source. It is also known to insert a fuse, circuit breaker, ground fault circuit interrupter (GFCI), or other circuit protection device into an electrical circuit so that if the current exceeds a safe level or otherwise behaves in an abnormal fashion, the protection device is converted from its normal state into an abnormal state in which it disconnects the circuit from the power supply or otherwise prevents maintenance of the abnormal current. The protection device can, for example, be placed in a plug through which a heater or other operational device is connected to a wall outlet in a building or to another power source. When an electrical circuit contains both a signal light and a protection device, absence of the signal light may signify failure of the operational device itself, or failure of the electrical connections to the operational device, or conversion of the protective device into its abnormal state, e.g. failure ("blowing") of the fuse.

Self-regulating strip heaters which comprise elongate electrodes connected by a conductive polymer resistive element are well-known. In operation, the thermal output of these strip heaters varies in response to changes in the thermal environment and thus serves to limit the maximum temperature which the heater achieves. Such heaters are often used to provide freeze protection of pipes, such as domestic or commercial water lines, or to maintain a constant temperature for pipes in process industries. A number of measures have been proposed for assisting the safe operation of such heaters. Reference may be made, for example, to U.S. Pat. No. 4,436,986 (Carlson) and U.S. Pat. No. 4,822,983 (Bremner et al) and to copending commonly assigned application Ser. No. 404,730, filed Sept. 8, 1989 (Emmett). The disclosure of each of these patents and applications is incorporated herein by reference.

SUMMARY OF THE INVENTION

I have now realized that when a conductive polymer strip heater is connected to a power supply through an electrical plug which is inserted into a conventional wall outlet and which contains a fuse or other protective device, it is very useful to include, as a part of the plug, a signal device, e.g. a light-emitting diode, which is connected between the two legs of the heater circuit so that it will provide a signal (e.g. will be lit up) only when the power is on and the protective device is in its normal state.

In a first aspect, this invention provides an electrical plug for connecting an electrical lead comprising a first conductor and a second conductor to an electrical power outlet, which plug comprises (1) a first contact member which comprises (a) a first prong suitable for insertion into one socket of the power outlet, and (b) a first fuse-contact section;

(2) a second contact member which comprises (a) a first conductor-contact section to which the first conductor can be physically and electrically connected, and (b) a second fuse-contact section;

(3) a third contact member which comprises (a) a second conductor-contact section to which the second conductor can be physically and electrically connected, and (b) a second prong suitable for insertion into the other socket of the power outlet; and (4) a signal member which is connected between the second and third contact members and which provides a signal when current is passing therethrough, whereby, when the first and second prongs are inserted into the power outlet, the signal member provides a signal if a fuse connects the first and second fuse contact sections and does not provide a signal if there is no electrical connection between the first and second fuse contact sections.

In a second aspect, this invention provides an electrical plug for connecting an electrical lead comprising a first conductor and a second conductor to an electrical power outlet, which plug comprises (A) a conductor-receiving member which comprises (1) a first channel in which the first conductor can be placed, and (2) a second channel in which the second conductor can be placed; and (B) a conductor-connecting member which comprises (1) a first contact member which comprises (a) a first prong suitable for insertion into one socket of the power outlet and (b) a first fuse-contact section, (2) a second contact member which comprises (a) a first conductor-contact section and (b) a second fuse-contact section, (3) a third contact member which comprises (a) a second conductor-contact section and (b) a second prong suitable for insertion into the other socket of the power outlet, and (4) a signal member which is connected between the second and third contact members and which provides a signal when current is passing therethrough;

the conductor-receiving member and the conductor-connecting member being (i) movable relative to each other between a unique mated configuration and a plurality of demated configurations;

(ii) such that in at least some of the demated configurations, the first conductor can be placed in the first channel and the second conductor can be placed in the second channel;

(iii) such that if the first conductor has been placed in the first channel and the second conductor has been placed in the second channel, the conductor-receiving member with the conductors placed therein and the conductor-connecting member can then be brought into the mated configuration, in which mated configuration the first conductor makes physical and electrical contact with the first conductor-contact section and the second conductor makes electrical contact with the second conductor-contact section; and (iv) such that they cannot be brought into the mated configuration if the first conductor or the second conductor has been placed in direct physical contact with the respective conductor-contact section instead of being placed in the respective channel; and (C) closure means for maintaining the conductor-receiving member and the conductor-connecting member in the mated configuration, whereby when the first and second prongs are inserted into the power outlet, the signal member provides a signal if a fuse connects the first and second fuse-contact sections and does not provide a signal if there is not electrical connection between the first and second fuse-contact sections.

In a third aspect, this invention provides an electrical plug assembly which comprises (A) a plug comprising (1) a first contact member which comprises (a) a first prong suitable for insertion into one socket of a power outlet, and (b) a first fuse-contact section;

(2) a second contact member which comprises (a) a first conductor-contact section to which a first conductor can be physically and electrically connected, and (b) a second fuse-contact section;

(3) a third contact member which comprises (a) a second conductor-contact section to which a second conductor can be physically and electrically connected, and (b) a second prong suitable for insertion into the other socket of a power outlet;

(4) a signal member which is connected between the second and third contact members and which provides a signal when current is passing therethrough, and (B) a fuse which is positioned between the first and second fuse contact sections, whereby, when the first and second prongs are inserted into the power outlet, the signal member provides a signal if the fuse electrically connects the first and second fuse contact sections and does not provide a signal if there is no electrical connection between the first and second fuse contact sections.

DETAILED DESCRIPTION OF THE INVENTION

The electrical plug of the invention is used to connect an electrical lead comprising a first conductor and a second conductor to an electrical power outlet. The power outlet may be a wall outlet either inside or outside of a building, or it may be part of a power supply or other suitable source of power. The outlet may be two-hole for connection to a phase and a neutral wire, or three-hole for connection to a phase, a neutral, and a ground (earth) wire. The electrical lead may be any electrical component with a first conductor and a second conductor, e.g. an electrical power cord. The plug is particularly useful in making an electrical connection to a strip heater, i.e. an elongate heating element which comprises at least two electrodes. For a connection made with this type of heater, the first conductor is one electrode of the heater and the second conductor is the other electrode of the heater. The strip heater may comprise a conductive polymer, i.e. a composition in which a particulate conductive filler is dispersed or otherwise distributed in a polymeric component. Particularly preferred are self-regulating conductive polymer heaters, i.e. those which exhibit PTC (positive temperature coefficient) behavior. The electrodes of a self-regulating heater are generally elongate metal wires or braid which are parallel and spaced apart. They are attached to or embedded in a resistive element which comprises the conductive polymer and is often in the form of a continuous strip. In order to provide environmental protection and electrical insulation, it is common for the resistive element and the electrodes to be covered by a dielectric layer, e.g. a polymeric jacket. A metallic grounding braid is often present over the dielectric layer in order to provide physical reinforcement and a means of electrically grounding the strip heater.

The term "PTC behavior" is used in this specification to denote a composition or an electrical device which has an $R_{14}$ value of at least 2.5 or an $R_{100}$ value of at least 10, and preferably both, and particularly one which has an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. Self-regulating conductive polymer heaters which exhibit PTC behavior, and appropriate conductive polymer compositions, are disclosed in U.S. Pat. Nos. 3,858,144 (Bedard et al), 3,861,029 (Smith-Johannsen et al), 4,188,276 (Lyons et al), 4,388,607 (Toy et al), and 4,426,339 (Kamath et al), and copending, commonly assigned application Ser. No. 404,730 (Emmett), filed Sept. 8, 1989. The disclosure of each of these patents and applications is incorporated herein by reference.

Figure 1:
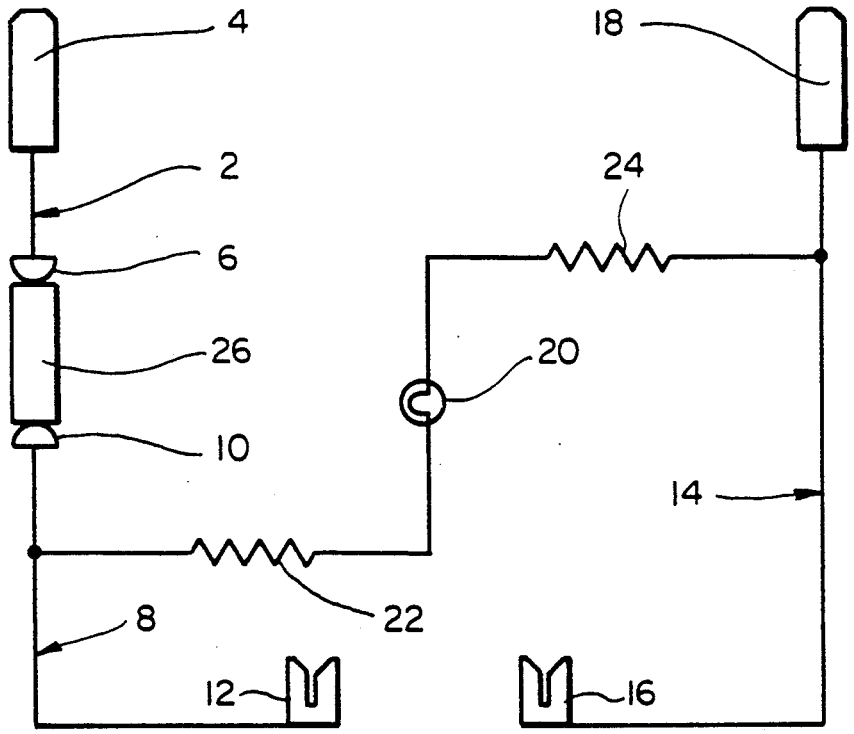
FIG. 1 is a schematic circuit diagram of an electrical plug of the invention.

The invention is illustrated by the drawings. FIG. 1 shows a schematic circuit diagram for the plug which is designed for insertion into an electrical power outlet. A first contact member 2 comprises a first prong 4 which can be inserted into one socket of the outlet and a first fuse-contact section 6. A second contact member 8 comprises a second fuse-contact section 10 and a first conductor-contact section 12 to which a first conductor of an electrical lead can be physically and electrically connected. A third contact member 14 comprises a second conductor-contact section 16 to which the second conductor of an electrical lead can be physically and electrically connected and a second prong 18 which can be inserted into the other socket of the outlet. A signal member 20 is electrically connected between the second and third contact members. In this embodiment, the signal member 20 is electrically in series with a first resistor 22 and a second resistor 24. When the first and second prongs 4, 18 are inserted into the power outlet, the signal member 20 provides a signal if a fuse 26 connects the first and second fuse-contact sections 6, 10. No signal is provided if there is no electrical connection between the first and second fuse-contact sections 6, 10. The signal member 20 may be a light, e.g. a light emitting diode (LED), which provides a visual signal, a bell or other apparatus which provides an audio signal, or an electrical switch which can generate an alarm signal. Other types of signal members may be appropriate in different circumstances.

The first and second fuse-contact sections 6, 10 are positioned to receive a fuse 26. The selection of a specific fuse is dependent on the normal operating conditions and the anticipated fault conditions. Particularly preferred when the connection is to be made to a strip heater is a very fast acting fuse, i.e. a fuse which has little, if any intentional delay in the overload region and which "trips" (opens) very rapidly when the current in the circuit comprising the fuse exceeds the rated value of the fuse. Appropriate fuses are very fast-acting ceramic ferrule fuses with a current rating of 10 amperes and a voltage rating of 125/250 volts. Such fuses are available, for example, from the Bussman Division of Cooper Industries under the name Buss GBB TM -10. While it is possible to use one of the measures disclosed in U.S. Pat. No. 4,822,983 (Bremner et al) in conjunction with this invention, I have found that, when a fuse as just described is employed, excellent results can be obtained without using a sensor conductor as disclosed in that patent.

Figure 2B:
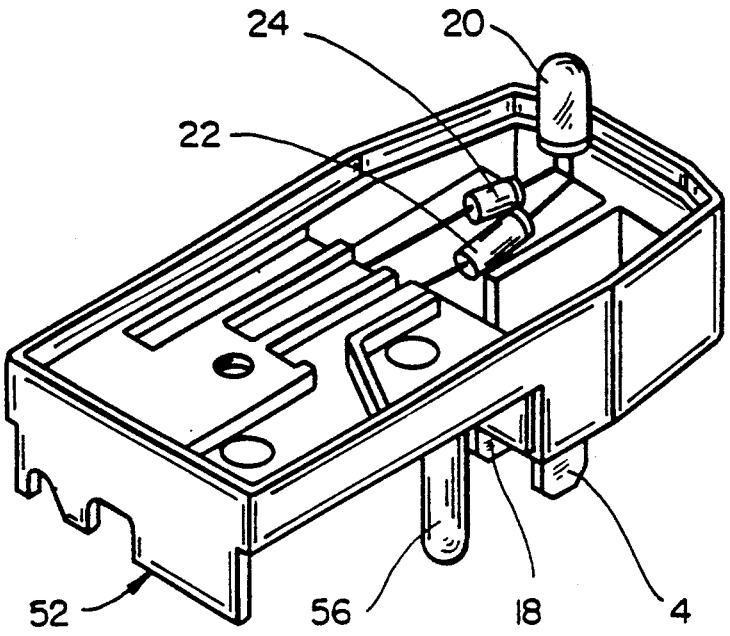
FIG. 2B is a perspective view of the bottom of a component of the connector of the invention.
Figure 2A:
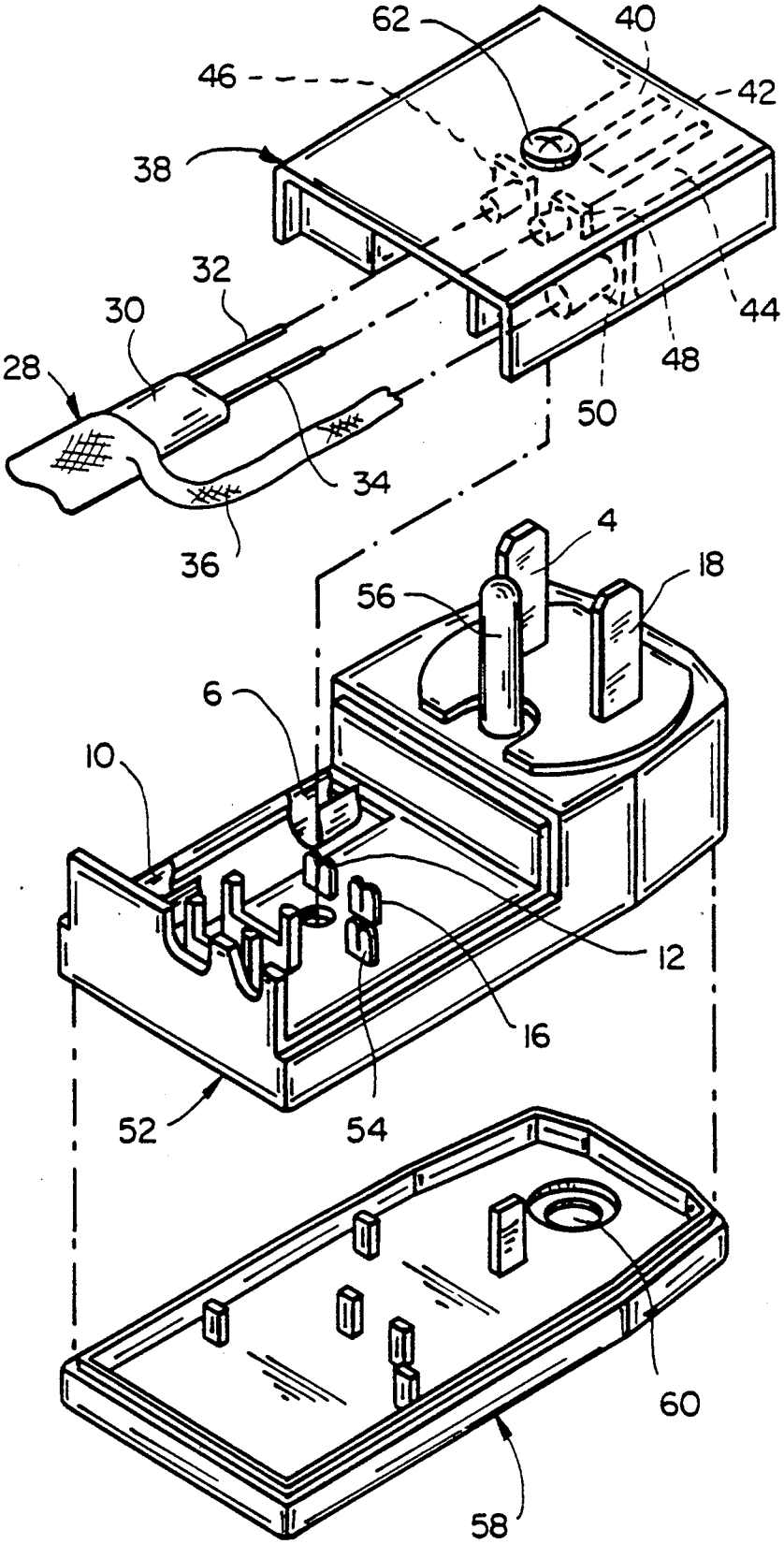
FIG. 2A shows an exploded view of a plug of the invention.

FIG. 2A shows an exploded view of one specific embodiment of the plug which is designed to connect the conductors of an electrical lead 28 to an electrical power outlet. In this figure the electrical lead 28 is a strip heater which comprises a resistive element 30, and embedded therein, a first conductor 32 and a second conductor 34. The heater is surrounded by a metallic grounding braid 36. Both the first conductor 32 and the second conductor 34 have been stripped of the conductive polymer which comprises the resistive element 30 to allow easy insertion into the conductor-receiving member 38. For other types of leads, e.g. insulated wires, it may not be desirable to remove the polymeric insulation or jacketing material. The conductor-receiving member 38 comprises a first channel 40, a second channel 42, and a third channel 44, designed for insertion of the first conductor 32, the second conductor 34, and the grounding lead 36, respectively. Each channel is a tunnel which has a frusto-conical opening, both features sized so that the conductors inserted in them can be held by frictional forces. The walls of the channels serve to prevent contact between the conductors. A radial opening 46, 48, 50 is cut through each tunnel to allow electrical connection of the inserted conductor to the conductor-contact sections. Once the conductors are inserted into the conductor-receiving member 38, it is mated to the conductor-contact connecting member 52. As a result of the design of the conductor-receiving member, which may include positioning pins or other design elements which are not shown, there is a unique mated configuration. When the two pieces are mated, the first conductor 32 is in physical and electrical contact with the first conductor-contact section 12, the second conductor 34 is in physical and electrical contact with the second conductor-contact section 16, and the grounding lead 36 is in physical and electrical contact with the grounding contact section 54. The first and second conductor-contact sections 12, 16 and the grounding contact section 54 may comprise insulation-piercing means for use when the conductors are insulated with a polymeric jacket. The conductor-connecting member further comprises first and second fuse-contact sections 6, 10 designed to receive a fuse. The first connection-making section 4 corresponds to the first prong of FIG. 1 and the second connection-making section 18 corresponds to the second prong. A ground-connection-making section 56 is also present to connect to the ground in the outlet. The embodiment shown also comprises a base 58 for the conductor-connecting member 52 which can be welded, glued, or snapped into place. A signal port 60 is positioned so that the signal member 20 will be visible. FIG. 2B shows the bottom of the conductor-connecting member 52 with the base 58 removed. The signal member 20, an LED, and first and second resistors 22, 24 are visible. It is apparent that the first fuse-contact section 6 and the first connection-making section 4 are made from a single piece of metal, e.g. brass. In this embodiment, the second conductor-contact section 16 and the second connection-making section 18 are also made from a single piece of metal, as are the second fuse-contact section 10 and the fuse conductor-contact section 12.

The conductor-receiving member 38 is preferably made from an insulating material, e.g. a polymer. It is particularly preferred that it be made from a transparent polymer, e.g. polycarbonate, so that there is a visual indication that the conductors are properly positioned. The conductor-receiving member 38 and the conductor-connecting member 52 are maintained in position by a closure means 62, e.g. a screw or a clamp. When mated properly, the plug provides adequate strain relief to the electrical lead. A minimum pull force of 20 pounds on the electrical lead is achieved. (The "pull force" or "pullout force" measures the amount of force required to pull the electrical lead 0.125 inch (0.318 cm) out of the plug. This procedure is described in copending, commonly assigned application Ser. No. 281,580 (Bautista) filed Dec. 8, 1988, the disclosure of which is incorporated herein by reference.) Proper mating of the conductor-receiving member 38 and the conductor-connecting member 52 cannot be achieved if either the first conductor 32 or the second conductor 34 has been directly connected to the respective conductor-contact section 12, 16.

When the fuse 26 is in place but no conductors are inserted into the conductor-receiving member, the plug may be used to determine whether wall outlets are properly wired and/or live. If the fuse is electrically intact and there is no signal when the plug is placed into the outlet, that is an indication that the outlet is defective. Additional signal members can be incorporated into the plug to signal whether the phase and neutral wires are wired correctly. When there is a ground connection to the plug, additional signal members will indicate whether there is actually a ground.

What is claimed is:

1. An electrical plug for connecting an electrical lead comprising a first conductor and a second conductor to an electrical power outlet, which plug comprises (A) a conductor-receiving member which comprises
  (1) a first channel in which the first conductor can be placed, and
  (2) a second channel in which the second conductor can be placed; and (B) a conductor-connecting member which comprises
  (1) a first contact member which comprises (a) a first prong suitable for insertion into one socket of the power outlet and (b) a first fuse-contact section,
  (2) a second contact member which comprises (a) a first conductor-contact section and (b) a second fuse-contact section,
  (3) a third contact member which comprises (a) a second conductor-contact section and (b) a second prong suitable for insertion into the other socket of the power outlet, and (4) a signal member which is connected between the second and third contact members and which provides a signal when current is passing therethrough;

the conductor-receiving member and the conductor-connecting member being (i) movable relative to each other between a unique mated configuration and a plurality of demated configurations;

(ii) such that in at least some of the demated configurations, the first conductor can be placed in the first channel and the second conductor can be placed in the second channel;

(iii) such that if the first conductor has been placed in the first channel and the second conductor has been placed in the second channel, the conductor-receiving member with the conductors placed therein and the conductor-connecting member can then be brought into the mated configuration, in which mated configuration the first conductor makes physical and electrical contact with the first conductor-contact section and the second conductor makes electrical contact with the second conductor-contact section; and (iv) such that they cannot be brought into the mated configuration if the first conductor or the second conductor has been placed in direct physical contact with the respective conductor-contact section instead of being placed in the respective channel; and (C) closure means for maintaining the conductor-receiving member and the conductor-connecting member in the mated configuration, whereby when the first and second prongs are inserted into the power outlet, the signal member provides a signal if a fuse connects the first and second fuse-contact sections and does not provide a signal if there is not electrical connection between the first and second fuse-contact sections.

2. A plug according to claim 1 wherein the conductor-receiving member is composed of insulating material.

3. A plug according to claim 2 wherein the insulating material is transparent.

4. A plug according to claim 1 wherein each of the first and second channels is in the form of a tunnel having a radial opening therein, and when the conductor-receiving member and the conductor-connecting member are in the mated configuration, the respective conductor-receiving sections pass through the radial openings.

5. A plug according to claim 4 wherein the conductor-receiving member further comprises a third channel in which a ground lead can be placed.

6. A plug according to claim 1 wherein the signal member comprises a light.

* * * * *

UNITED STATES PATENT AND TRADEMARK OFFICE

CERTIFICATE OF CORRECTION

PATENT NO. : 5,002,501

DATED : March 26, 1991

INVENTOR(S) : Donald L. Tucker

It is certified that error appears in the above-identified patent and that said Letters Patent is hereby corrected as shown below:

Column 5, line 47, replace "conductor-contact connecting member" by --conductor-connecting member--.

Column 6, line 30, after "Dec. 8, 1988," insert --now U.S. Pat. No. 4,883,945,--.

Claim 1, lines 29 to 30, replace "plurality of demated configurations" by --demated configuration--.

Claim 1, lines 31 to 32, replace "at least some of the demated configurations" by --the demated configuration--.

Signed and Sealed this

Sixth Day of July, 1993

Michael K. Kirk

*Attest:*

MICHAEL K. KIRK

*Attesting Officer*

*Acting Commissioner of Patents and Trademarks*